United States Patent [19]

Koyama et al.

[11] Patent Number: 4,531,949

[45] Date of Patent: Jul. 30, 1985

[54] ENTRAINED FLOW COAL GASIFICATION PROCESS

[75] Inventors: Syuntaro Koyama; Jinichi Tomuro, both of Katsuta; Tomohiko Miyamoto, Takahagi; Yoshiki Noguchi; Yukio Hishinuma, both of Hitachi, all of Japan

[73] Assignee: Hitachi, Ltd., Tokyo, Japan

[21] Appl. No.: 517,034

[22] Filed: Jul. 25, 1983

[30] Foreign Application Priority Data

Aug. 25, 1982 [JP] Japan ..... 57-146082

[51] Int. Cl.[3] ..... C10J 3/46

[52] U.S. Cl. ..... 48/202; 48/206; 48/210; 48/DIG. 4; 252/373

[58] Field of Search ..... 48/210, 206, DIG. 4, 48/DIG. 2, 202; 252/373

[56] References Cited

U.S. PATENT DOCUMENTS 3,817,723 6/1974 Donath ..... 48/210

4,168,956 9/1979 Blaskowski ..... 48/210

FOREIGN PATENT DOCUMENTS 2507124 8/1975 Fed. Rep. of Germany ..... 48/206

OTHER PUBLICATIONS

Young, "Recent Development in High Pressure, Entrained Flow, Slagging Gasification of Coal", Aug. 4–6, 1981.

*Primary Examiner*—Peter Kratz

*Assistant Examiner*—Joye Woodard

*Attorney, Agent, or Firm*—Antonelli, Terry & Wands

[57] ABSTRACT

A process for gasifying coal comprising supplying to an upper portion of an entrained flow gasifier a coal powder having a particle size of 100 μm or less whereby gasification is conducted at 900° C. or higher in the absence of oxygen, supplying a coal powder including coarser particles and oxygen in an amount from that necessary for complete combustion of coal to a half of said amount to a lower portion of the gasifier whereby gasification is conducted at a melting point of coal ash or higher, and leading the gases produced at the lower portion of the gasifier directly to the upper portion of the gasifier, does not require recycle of char to the gasifier and gives a high gasification efficiency by passing coal powder through the gasifier only one time.

5 Claims, 6 Drawing Figures

ENTRAINED FLOW COAL GASIFICATION PROCESS

BACKGROUND OF THE INVENTION

This invention relates to a process for gasifying coal, more particularly it relates to a process for gasifying coal using a two-stage entrained flow gasifier with high gasification efficiency and excellent operation controllability.

Processes for gasifying coal with high efficiency to give raw materials for chemicals, fuel for industrial use and town gas are now under development.

Entrained flow coal gasification wherein the gasification temperature is higher than the melting point of coal ash has the following features and is expected to be employed widely as coal gasification process:

(a) Gasification rate of carbon can be increased.

(b) Since tar can be decomposed completely, troubles caused by tar can be prevented.

(c) Since coal ash can be taken out in the form of molten slag, it can be disposed as it is without causing much troubles in environmental pollution.

The entrained flow coal gasification processes can be divided into two categories, one of which comprises injecting a gasifying agent (oxygen or air and steam) and coal through a single feed burner to a gasifier to produce gases rich in $H_2$ and CO by partial combustion (a one-stage gasification process) and the other of which comprises supplying coal or char which is a pyrolysis product of coal separately from two feed burners to produce gases rich in $H_2$, CO and $CH_4$ by pyrolysis and partial combustion (a two-stage gasification process).

There are known the following two main processes in the two-stage gasification process:

(i) A process wherein coal is subjected to pyrolysis, and produced char is subjected to combustion or partial combustion, while using the heat generated as heat source for the pyrolysis. (Bi-Gas process, e.g., "Recent Development in High Pressure, Entrained Flow, Slagging Gasification of Coal" by R. K. Young in 8th International Conference on Coal Gasification, Liquefaction & Conversion to Electricity: University of Pittsburgh, Pittsburgh, PA., August 4–6, 1981).

(ii) A process wherein coal is supplied not only to a pyrolysis zone but also to a combustion zone of char and is gasified together with char. (Combustion Engineering Process, e.g., U.S. Pat. No. 4,168,956).

But even employing the one-stage or two-stage entrained flow gasification processes mentioned above, coal is not gasified completely in a gasifier by one pass, so that unreacted carbon particles are present in particles flying out of the gasifier (such particles are called "char") and the gasification efficiency cannot be improved unless the char is recovered and recycled to the gasifier.

Typical gasification reactions of coal can be represented by the following equations:

$$\text{Coal} \rightarrow \text{Char(C)} + CH_4 + H_2 + CO \quad (1)$$

$$C + O_2 \rightarrow CO_2 \quad (2)$$

$$C + CO_2 \rightarrow 2\,CO \quad (3)$$

$$C + H_2O \rightarrow H_2 + CO \quad (4)$$

$$CO + H_2O \rightleftarrows CO_2 + H_2 \quad (5)$$

The pyrolysis reaction (1) and the shift reaction (5) take place relatively rapidly and the combustion reaction (2) is completed in very short time. But the reactions (3) and (4) are slow in reaction rate compared with the rest of the reactions and take much time for gasification. Therefore the improvement in gasification efficiency depends on how to make the reactions (3) or (4) faster. The reaction rate in the reaction (3) or (4) is influenced by the reaction temperature, partial pressures of gasifying agents, properties of coal particles, etc. According to the gasification processes mentioned above, optimum conditions are not always employed, so that char is discharged from a gasifier.

On the other hand, recycle of char gives the following defects in operation of gasifying apparatus. Since char is recovered, in general, in afterflow of the gasifier, that is, in a place wherein the pressure is lower than that of the gasifier (e.g. a cyclone), char tends to flow reversely to the lower pressure side in the recycling system. Thus, it is necessary to install devices or apparatus which are resistant to the gas flow such as a char feeder, valves, a particle packing layer, etc., which results in making the controlling system of the char recycle complicated and making operating characteristics of gasifier worse. Particularly in the case of the Bi-Gas process mentioned above (i), since the recycle of char is a premise and the gasification temperature is maintained by combustion heat of char, reduction in flow rate of char in the recycle system or no flow of char lowers the temperature at the combustion zone, solidifies coal ash and closes the flowing down passage of slag, whereas the temperature at the pyrolysis zone is lowered, tar is produced and coking troubles are caused at the afterflow of gasifier, which results in causing stoppage of operation of the gasifier. Further, in the Bi-Gas process, when steam which is a gasifying agent is used for transporting char, control of the recycle system becomes more complicated since both the gasification conditions and the transport conditions should be satisfied at the same time.

The Combustion Engineering process mentioned above (ii) is improved in operation of the gasifier compared with the Bi-Gas process since coal is supplied from upper and lower portions separately and the gasification temperature can be maintained even the supply of char becomes unstable. But the gasification conditions are not optimum and char is still recycled.

As mentioned above, there is a fatal defect in the entrained flow gasification that improvement of gasification efficiency can only be attained by recycling char.

SUMMARY OF THE INVENTION

It is an object of this invention to provide a process for gasifying coal by using a two-stage entrained flow gasifier with high efficiency by only passing coal particles once in the gasifier.

This invention provides a process for gasifying coal by supplying pulverized coal separately to two different levels in an entrained flow gasifier which comprises supplying a coal powder having a particle size of 100 μm or less to an upper portion of the gasifier, whereby gasification is conducted at 900° C. or higher in the absence of oxygen, supplying a coal powder including coarser particles and oxygen in an amount from that necessary for complete combustion of coal to a half of said necessary amount to a lower portion of the gasifier, whereby gasification is conducted at a melting point of coal ash or higher and leading the gases produced at the lower portion of the gasifier directly to the upper portion of the gasifier.

DESCRIPTION OF THE PREFERRED EMBODIMENTS

This invention has been accomplished by studying with a large number of experiments how to select gasification conditions such as a distribution ratio of coal supply to a pyrolysis zone to a combustion zone, a supply ratio of coal to a gasifying agent, particle size of coal, temperature distribution in the gasifier, in order to increase gasification efficiency. Hereinafter, results of such experiments are explained with reference to the steps employed in this invention.

First of all, the following three conditions should be satisfied in the entrained flow gasification.

1. The tar produced by pyrolysis is decomposed (or gasified) completely.
2. Generating amounts of $H_2$ and CO per unit weight of coal are increased as much as possible.
3. After satisfying the above-mentioned conditions 1 and 2, the reaction rate of the reaction equation 3 or 4 mentioned above should be increased.

Figure 1:
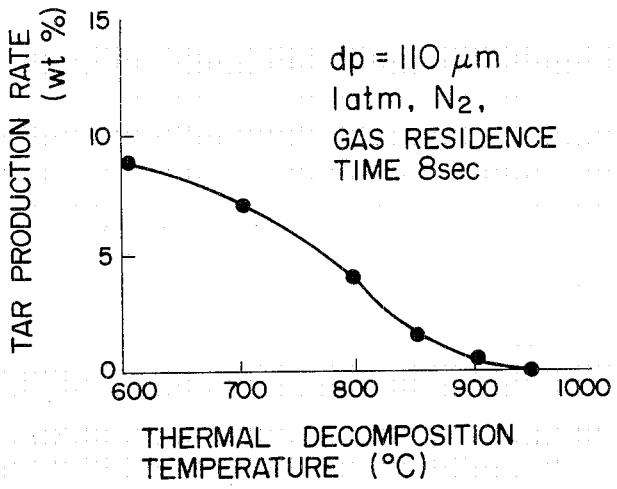
FIG. 1 is a graph showing pyrolysis properties of coal.

FIG. 1 is a graph showing pyrolysis properties of coal. In FIG. 1, a relationship between a tar production rate and pyrolysis (or thermal decomposition) temperature is shown using Taiheiyo coal having a composition and properties as shown in Table 1 and a particle size of 110 μm under a nitrogen stream at atmospheric pressure with a gas residence time of about 8 seconds. It is clear from FIG. 1 that the production of tar can be reduced by increasing the temperature, and almost whole amount of tar can be decomposed at a temperature of 900° to 950° C.

Figure 2:
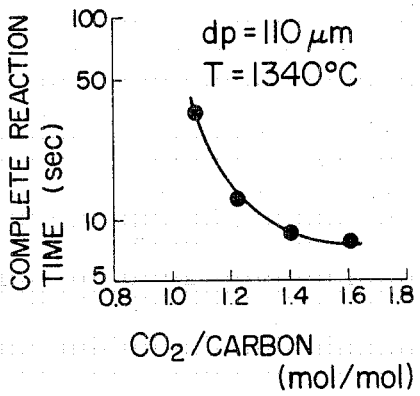
FIGS. 2 and 3 are graphs showing gasification properties of coal by $CO_2$.

FIG. 2 is a graph showing gasification properties of coal with carbon dioxide ($CO_2$) using Taiheiyo coal having a particle size of 110 μm at 1340°0 C. As is clear from FIG. 2, the larger the ratio of $CO_2/C$ becomes, the shorter the time required for almost 100% reaction of carbon (i.e. complete reaction time $\theta_0$) becomes. Particularly, the complete reaction time is reduced remarkably until the $CO_2/C$ ratio becomes 1.2 (mol/mol). This is because the reaction rate of the reaction $C+CO_2 \rightarrow 2$ CO is proportional to the partial pressure of $CO_2$. The partial pressure of $CO_2$ is lowered with the progress of the reaction at $CO_2/C=1/1$ (mol/mol) and thus the slower the reaction rate becomes, the closer the convertion of carbon becomes 100%. Therefore, in the reaction represented by the reaction equation (3), it is effective to make the $CO_2/C$ ratio 1.2 (mol/mol) or more, more preferably 1.4 or more.

Figure 3:
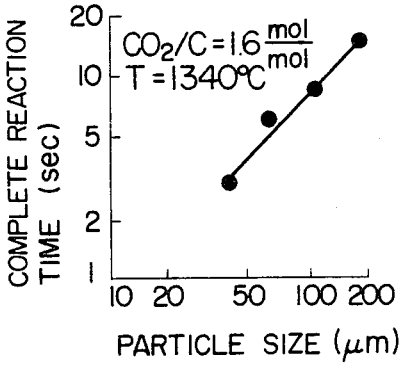

FIG. 3 is a graph showing a relationship between the complete reaction time $\theta_0$ and a particle size (dp) of coal in the reaction of reaction equation (3) at $CO_2/C$ ratio of 1.6 (mol/mol) and 1340° C. using Taiheiyo coal. As is clear from FIG. 3, the complete reaction time is proportional to the particle size of coal. When the particle size of coal is 100 μm or less, almost complete gasification can be obtained within 10 seconds or less.

The shorter complete reaction time can make the volume of gasifier smaller or can make the treating amount of coal in the same volume of gasifier larger. Therefore, the smaller particle size of coal is expected to bring about the better results, whereas the power required for pulverizing the coal becomes larger when the particle size becomes smaller. Therefore, it is necessary to select a proper particle size of coal taking the both into consideration. Since coal particles are moved together with gases in the entrained flow gasifier, the residence time of coal particles is considered to be very close to that of gases, so that the volume of gasifier is determined by regarding that the residence time of gases is the complete reaction time of coal particles. In the entrained flow, the gas velocity is usually controlled to be 2 to 10 m/sec, so that the height of gasifier required becomes 20 to 100 meters when the complete reaction time of, for example, 10 seconds is necessary. It is not preferable to use a too large gasifier considering heat loss of gasifier, and problems on practical operation and construction of gasifier. Taking the above-mentioned conditions into consideration, the complete reaction time of several seconds is more preferable, and thus the use of coal having a particle size of 50 μm or less is more preferable.

In the combustion reaction of coal with oxygen, it is known that carbon conversion is improved when the ratio of oxygen feed rate to coal feed rate becomes larger. But since the content of $CO_2$ in the gases produced increases larger and the contents of $H_2$ and CO decrease when nearer the complete combustion, it is not preferable to simply increase the amount of oxygen from the viewpoint of increasing the contents of effective gas components.

Considering the above-mentioned gasification characteristics totally, the conditions necessary for carrying out the process of this invention are determined. That is:

(i) A part of pulverized coal supplied to the lower portion of the gasifier is gasified under conditions near to complete combustion to conduct complete gasification at a melting point of coal ash or higher.

(ii) The high temperature gases rich in $CO_2$ produced in the above-mentioned (i) is contacted with the residual coal in the above-mentioned (i) to cause the following gasifying reaction: $C+CO_2 \rightarrow 2$ CO. Said gasifying reaction is conducted by leading the gases produced at the lower portion of the gasifier directly to the upper portion of the gasifier, wherein the temperature is maintained at 900° C. or higher to completely decompose tar produced considering the results shown in FIG. 1.

(iii) Since the reaction in the above-mentioned (ii) requires much more time for gasification compared with that in the above-mentioned (i), pulverized coal (or coal powder) including relatively coarser particles is supplied to the lower portion of the gasifier so as to conduct the reaction of the above-mentioned (i) and coal powder having a finer particle size (100 μm or less, preferably 50 μm or less referring to the results shown in FIG. 3) is supplied to the upper portion of the gasifier so as to conduct the reaction of above-mentioned (ii). At the same time, the feed rate of coal to the lower portion is made larger than that to the upper portion so as to make the ratio of the $CO_2$ produced in the reaction in the above-mentioned (i) to the coal supplied to the reaction in the above-mentioned (ii) preferably 1.2 (mol/mol) or more, more preferably 1.6 (mol/mol) or more referring to the results shown in FIG. 2.

(iv) Since the gasification zone wherein the reaction of above-mentioned (i) takes place tends to show remarkably high temperatures and to damage the gasifier material, the temperature is controlled by feeding steam or water while maintaining the temperature at a melting point of coal ash or higher. The steam reacts with coal in the gasification zone wherein the reaction of the above-mentioned (ii) takes place so as to improve the gasification efficiency by causing the reaction: $C+H_2O \rightarrow H_2+CO$.

Figure 4:
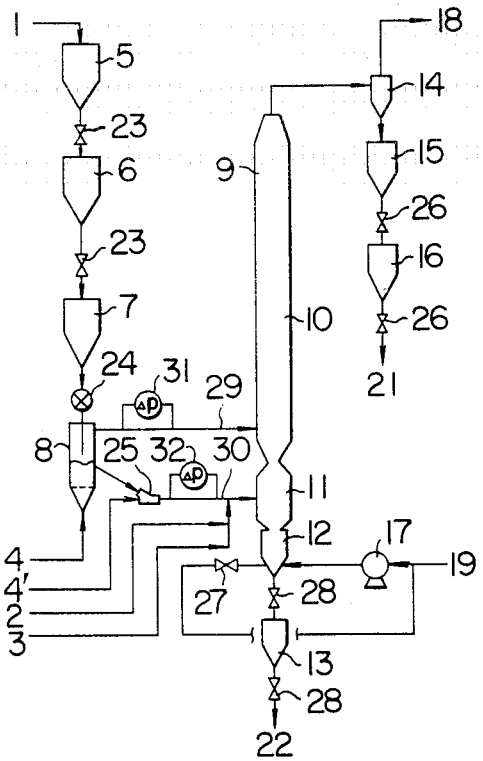
FIG. 4 is a flow sheet showing one embodiment of coal gasification process according to this invention.

This invention is explained in detail referring to FIG. 4 which illustrates an optimum embodiment of this invention.

Figure 5:
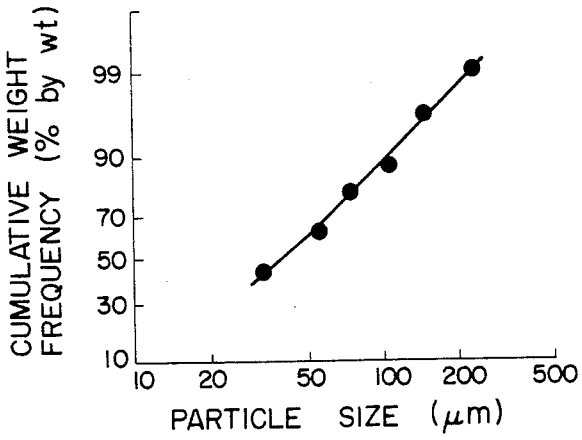
FIG. 5 is a graph showing particle size distribution of coal.

Pulverized coal 1 is stored in a normal pressure hopper 5. From this, the pulverized coal is dropped into pressurized hoppers 6 and 7. These hoppers 5, 6 and 7 are known as so-called lock hoppers. Then the pulverized coal is supplied quantitatively to a fluidized-bed distributor 8 from the pressurized hopper 7 via a rotary feeder 24. Numeral 23 is a valve. In the fluidized-bed distributor 8, the pulverized coal is fluidized by a fluidizing gas 4 (e.g., $N_2$, $CO_2$ or a part of gases produced) so as to distribute the pulverized coal into coarser particles and finer particles by selecting a proper gas velocity. That is, some particles are entrained with a gas flow and some particles are not. By increasing the gas velocity, the amount of entrained particles increases. FIG. 5 shows one example of particle size distribution of pulverized coal to be supplied to the entrained flow gasifier. To the pulverized coal having such a particle size distribution as shown in FIG. 5, when a gas flow, for example, having a gas velocity so as to entrain particles having a particle size of 100 μm or less (hereinafter referred to as "terminal velocity") is given, 85% by weight of particles among total supplied coal particles are entrained with the gas flow and the rest of the particles remains in the fluidized bed.

Figure 6:
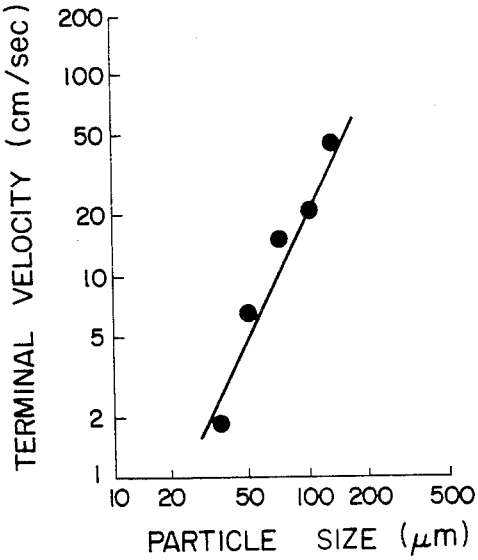
FIG. 6 is a graph showing a relationship between a terminal velocity of coal particles and particle size.

FIG. 6 is a graph showing a relationship between the terminal velocity $U_t$ and particle size at a nitrogen atmosphere at ordinary temperatures. FIG. 6 clearly shows that the terminal velocity is proportional to the size. Therefore, the proportions of coal to be entrained with the gas flow and of coal to be retained in the fluidized bed can be changed at will and so long as the particle sizes against weight proportions of coal to be entrained are grasped from FIG. 5 and a suitable flow velocity corresponding to the terminal velocity $U_t$ is given from FIG. 6.

The coal entrained with the gas from the fluidized-bed distributor 8 is supplied together with the gas to an upper portion 10 in a gasifier 9 and the coal retained in the fluidized-bed distributor 8 is supplied to a lower portion 11 in the gasifier 9 by an ejector 25 together with the same kind of gas 4' as used as fluidizing gas 4 in the state of gas stream transport, Total feed rate of coal can be controlled by the rotary feeder 24, and the distributing amounts to the upper and lower portions of the gasifier can be controlled by the feed amount of the fluidizing gas 4 and the feed rates to the upper and lower portions of the gasifier can be grasped by observing pressure differences at 31 and 32 attaching to feed pipes 29 and 30.

The coal supplied to the upper portion 10 is immediately subjected to pyrolysis to convert to pyrolysis gases ($CH_4$, $C_2H_6$, $C_2H_4$, $H_2$, CO and $CO_2$) and char. To the lower portion 11, coal is supplied together with oxygen 2 as gasifying agent for gasification in an oxygen amount in the range from the amount necessary for complete combustion of coal to a half of said necessary amount. The gases produced in the lower portion 11 rich in $CO_2$ (and including $H_2O$, $H_2$, and CO) can be a heat source of pyrolysis at the upper portion 10 and at the same time convert to gases rich in CO and $H_2$ by the reaction with char at the upper portion 10.

It is necessary to maintain the temperature of the lower portion 11 at a melting point of coal ash or higher. Such a temperature is usually about 1600° to 1800° C. but changes depending on the kind of coal used. Since the near complete combustion conditions are employed in this invention, the temperature becomes higher, but it is preferable to control the temperature of the lower portion 11 at 1800° to 2600° C. considering the life of the gasifier material and the like. The temperature can be controlled by water or steam 3. The ash in the coal supplied to the lower portion 11 is completely melted and flows down into a slag quencher 12. Cooling water 19 is supplied to the slag quencher 12 by a slag cooling water recycling pump 17 and taken out so as to keep the water surface in the slag quencher 12 constant and returned to the slag cooling water recycling pump 17. The coal ash is taken out of the slag quencher 12 and sent to a slag hopper 13 which is a type of known lock hopper and the cooling water 19 and slag 22 are taken out therefrom. Numerals 27 and 28 are valves.

The coal supplied to the upper portion 10 is completely gasified by the high temperature gases rich in $CO_2$ and $H_2O$ directly lead from the lower portion 11. The temperature of the upper portion should be maintained at 900° C. or higher so as to decompose tar completely and can be controlled by changing the feed rate of coal to the upper portion in the range wherein the feed rate to the upper portion is smaller than that to the lower portion. When the feed rate of coal to the upper portion is reduced, the temperature of the upper portion is increased. Thus, the temperatures of upper and lower portions of the gasifier can be controlled as follows.

First, the feed rate of coal to the upper and lower portions is determined by controlling the amount of gas flow in the fluidized-bed distributor 8. To the lower portion, oxygen necessary for near the complete combustion of coal is supplied and at the same time water or steam is supplied so as to make the temperature at the lower portion 1800° to 2600° C. When the upper portion temperature becomes lower than 900° C., the gas flow rate in the fluidized-bed distributor 8 is lowered and the feed rate of coal to the upper portion is lowered so as to raise the upper portion temperature.

The ash is lead to a cyclone 14 in the form of powder together with the product gas 18, wherein the ash is separated from the product gas 18, and the product gas is lead to a heat recovery system and to a gas purification system. Numeral 15 is a cyclone hopper, numeral 16 a hopper, numeral 26 valve and numeral 21 the ash.

In the above-mentioned embodiment, Taiheiyo coal having a composition and properties as shown in Table 1 is used.

TABLE 1

| | | |
|---|---|---|
| Proximate analysis (wt %) | Moisture | 6.1% |
| | Ash | 11.4% |
| | Volatile matter | 43.8% |
| | Fixed carbon | 38.7% |
| Heating value | (HHV) | 6710 kcal/kg |
| Melting point of ash (oxidizing) | Softening point | 1290° C. |
| | Melting point | 1330° C. |
| | Fluid point | 1370° C. |

Table 2 shows gasification test results using the apparatus as shown in FIG. 4. In Table 2, Run No. 1 is a case wherein coal is supplied only from the lower nozzle to the lower portion of the gasifier (one-stage gasification process). In the one-stage gasification process, when the feed rate of oxygen is more than that of coal, although the temperature is raised, the proportion of $CO_2$ in the produced gases is increased but a cold gas efficiency is lowered. On the other hand, when the feed rate of oxygen is lowered and the feed rate of water is increased, the cold gas efficiency is improved but the temperature is lowered. Therefore, the conditions as listed in Table 2 are optimum ones in the one-stage gasification. Further, the carbon conversion in Run No. 1 is as low as 88.7%, which results show that it is necessary to recycle the char recovered from the cyclone 14 to the gasifier 9.

TABLE 2

| | | Run No. 1 | Run No. 2 | | Run No. 3 | |
|---|---|---|---|---|---|---|
| Pressure (atm) | | 4 | 4 | | 4 | |
| Temperature (°C.) | Upper portion | — | 1150 | | 980 | |
| | Lower portion | 1610 | 2450 | | 2230 | |
| Coal feed rate (kg/hr) | Upper portion (particle size 100 μm or less) | — | 8.4 | total 19.8 | 7.4 | total 19.8 |
| | Lower portion | 20.1 | 11.4 | | 12.4 | |
| Oxygen feed rate (kg/hr) | Lower portion | 13.8 | 13.8 | | 12.5 | |
| Water feed rate (kg/hr) | Lower portion | 2.4 | 9.1 | | 9.1 | |
| Produced amount of gases ($m^3$/hr) | | 35.5 | 35.2 | | 34.4 | |
| Gas composition (vol %) | $N_2$ | 1.9 | 1.6 | | 1.8 | |
| | $H_2$ | 35.0 | 35.6 | | 34.93 | |
| | CO | 58.2 | 48.0 | | 50.1 | |
| | $CO_2$ | 4.7 | 10.8 | | 9.1 | |
| | $CH_4$ | 0 | 2.7 | | 2.0 | |
| | $C_2H_6$ | 0 | 1.3 | | 1.3 | |
| | $H_2S$ | 0.18 | 0.17 | | 0.17 | |
| Heating value (kcal/$m^3$) | | 2820 | 3002 | | 3033 | |
| Carbon conversion*1 (%) | | 88.7 | 91.2 | | 89.4 | |
| Cold gas efficiency*2 (%) | | 74.2 | 79.5 | | 78.5 | |

Note

*1: Conversion of carbon in coal to gases.

$$*2\text{: Cold gas efficiency} = \frac{\left(\text{Heating value of produced gas}\right) \times \left(\text{Produced amount of gases}\right)}{\left(\text{Heating value of coal}\right) \times \left(\text{Feed rate of coal}\right)}$$

In Run No. 2, the same feed rate of oxygen as in Run No. 1 is supplied from the lower nozzle to the lower portion of the gasifier and coal is supplied from two nozzles so as to distribute the coal so that the ratio of coal to oxygen at the lower portion of the gasifier becomes near the complete combustion. As a result, the upper portion temperature becomes 1150° C., while the lower portion temperature becomes 2450° C. The lower portion temperature is sufficiently high to supply water, and as a result of water supply, almost 100% of coal is gasified at the lower portion of the gasifier. On the other hand, in the upper portion of the gasifier, pyrolysis gases such as $CH_4$ and $C_2H_6$ are produced and at the same time the char is gasified by the gases from the lower portion rich in $CO_2$ and $H_2O$. As a result, both the carbon conversion and the cold gas efficiency are improved compared with those of Run No. 1.

When the amount of water supplied is increased under the conditions that the upper portion temperature is not lower than 900° C., the carbon conversion can be increased, for example, upto about 95%. Such high carbon gasification rates do not require recycle of char.

On the other hand, when coal is supplied to both the upper and lower portions of the gasifier but the particle size of coal is not changed in the upper and lower portions and other conditions being the same as those of Run No. 2, there is obtained a gas having a very close composition to that of Run No. 2 but the carbon conversion is as low as 90% and the cold gas efficiency is also as low as 78.8%. This clearly shows that distribution of pulverized coal depending on the particle size of 100 μm or less prior to supplying to the gasifier is necessary and important in the process of this invention.

Run No. 3 is a case wherein oxygen feed rate is lowered in 10% compared with the case of Run No. 2 but the distribution ratio of supplying coal is about the same as in Run No. 2. Thus, the reaction at the lower portion becomes near to partial combustion rather than complete combustion in Run No.2. As is clear from Table 2, the carbon conversion is lower than that of Run No. 2 but is still higher than that of Run No. 1.

As mentioned above, by supplying pulverized coal to two portions, i.e., upper and lower portions of the gasifier while distributing the coal particles depending on a particle size of 100 μm or less, and by making the reaction at the lower portion nearer to complete combustion than partial combustion, there can be obtained advantages in that complete gasification can be obtained at the lower portion, since the lower portion temperature is by far higher than the melting point of coal ash, water or steam can be supplied to the lower portion to lower the lower portion temperature, the water or steam can function as gasifying agent to accelerate the gasification reaction in the upper portion, and the like. Further, since the lower portion temperature can be variable to some extent, coal ash having a higher melting point can also be used in this invention. This means that various kinds of coal can widely be used in the gasifier according to this invention.

What is claimed is:

1. A process for gasifying coal by supplying pulverized coal separately to two different levels in an entrained flow gasifier which comprises supplying a coal powder having a partical size of 100 μm or less to an upper portion of the gasifier whereby gasification is conducted at 900° C. or higher in the absence of oxygen, supplying a coal powder including coarser particles and oxygen in an amount from that necessary for complete combustion of coal to a half of said necessary amount for complete combustion to a lower portion of the gasifier whereby gasification is conducted at a melting point of coal ash or higher, and leading the gases produced at the lower portion of the gasifier directly to the upper portion of the gasifier; the separation of pulverized coal supplied to the upper portion and to the lower portion of the gasifier being conducted by feeding the coal to a fluidizing gas flow and the feed rate of coal to the upper portion and to the lower portion is controlled by changing the gas flow velocity, whereby the coal entrained with the gas flow is supplied to the upper portion and the coal not entrained with the gas flow is supplied to the lower portion, and the feed rate of coal to the lower portion is larger than that to the upper portion.

2. A process according to claim 3, wherein the coal powder supplied to the upper portion of the gasifier has a particle size of 50 μm or less.

3. A process according to claim 1, wherein the temperature of 900° C. or higher at the upper portion is controlled by changing the feed rate of coal to the upper portion so long as the feed rate of coal to the upper portion is smaller than that to the lower portion.

4. A process according to claim 1, wherein the temperature of the melting point of coal ash or higher at the lower portion is controlled by supplying water or steam.

5. A process according to claim 4, wherein the temperature of the lower portion is 1800° to 2600° C.

* * * * *